US005867192A

United States Patent [19]

Mantell et al.

[11] Patent Number: 5,867,192

[45] Date of Patent: Feb. 2, 1999

[54] THERMAL INK JET PRINTHEAD WITH PENTAGONAL EJECTOR CHANNELS

[75] Inventors: David A. Mantell, Rochester, N.Y.; Eric Peeters, Mountain View, Calif.; James F. O'Neill, Penfield, N.Y.

[73] Assignee: Xerox Corporation, Stamford, Conn.

[21] Appl. No.: 805,876

[22] Filed: Mar. 3, 1997

[51] Int. Cl.[6] ..... B41J 2/05

[52] U.S. Cl. ..... 347/65

[58] Field of Search ..... 347/65, 63, 20

[56] References Cited

U.S. PATENT DOCUMENTS

| | | | |
|---|---|---|---|
| 4,216,477 | 8/1980 | Matsuda | 347/70 |
| 4,376,945 | 3/1983 | Hara | 347/63 |
| 5,508,725 | 4/1996 | Goto | 347/65 |
| 5,665,249 | 9/1997 | Burke et al. | 216/2 |

OTHER PUBLICATIONS

Alavi et al., "Laser Machining of Silicon for Fabrication of New Microstructures," 1991 IEEE.

*Primary Examiner*—Joseph Hartary
*Attorney, Agent, or Firm*—R. Hutter

[57] ABSTRACT

In an ink-jet printhead, channels in which liquid ink is nucleated by a heating element defines five sides in cross-section. One of the sides is created by the main surface of a heater chip which includes the heating element, while the other four sides, forming a truncated parallelogram or diamond-shape, are defined in a channel plate abutting the heater chip. The four-sided channel in the channel plate is created by a combined process of plasma etching and wet etching.

7 Claims, 1 Drawing Sheet

FIG. 1
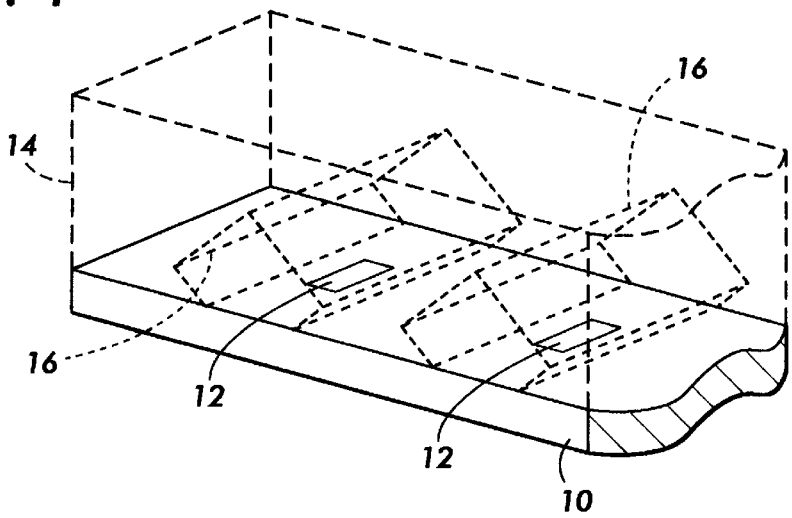
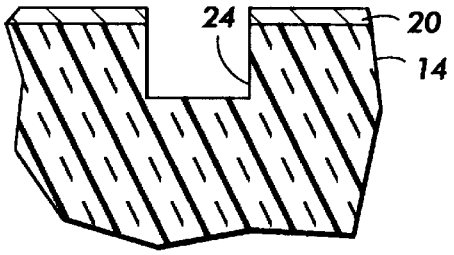
FIG. 2A
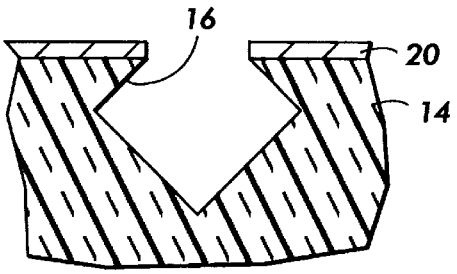
FIG. 2B

THERMAL INK JET PRINTHEAD WITH PENTAGONAL EJECTOR CHANNELS

FIELD OF THE INVENTION

The present invention relates to a printhead for a thermal ink-jet printer, in which the fluid flow channel of each ejector is specially shaped for optimal performance.

BACKGROUND OF THE INVENTION

In thermal ink-jet printing, droplets of ink are selectably ejected from a plurality of drop ejectors in a printhead. The ejectors are operated in accordance with digital instructions to create a desired image on a print sheet moving past the printhead. The printhead may move back and forth relative to the sheet in a typewriter fashion, or it may be of a size extending across the entire width of a sheet, to place the image on a sheet in a single pass.

The ejectors typically comprise capillary channels, or other ink passageways, which are connected to one or more common ink supply manifolds. Ink is retained within each channel until, in response to an appropriate digital signal, the ink in the channel is rapidly heated by a heating element disposed on a surface within the channel. This rapid vaporization of the ink adjacent the channel creates a bubble which causes a quantity of liquid ink to be ejected through an opening associated with the channel to the print sheet. The process of rapid vaporization creating a bubble is generally known as "nucleation."

One common design of an ink-jet printhead is known as a "sideshooter." In a sideshooter design, the channels forming the ejectors are formed between two silicon chips, generally known as a heater chip and a channel plate. The heater chip includes a main surface having defined therein a number of selectably actuable heating elements, usually one heating element per ejector. The channel plate is bonded to the heater chip, and has defined therein a set of grooves, one groove for each ejector. Together, the heater chip and channel plate form a set of nozzles, with one heating element in the heater chip corresponding to each channel in the channel plate, resulting in a set of tubes in which a heating element is exposed within each tube.

In known commercial designs of such a sideshooter printhead, the channel plate is formed from crystalline silicon, and the channels are formed by orientation-dependent etching (ODE) to form V-shaped grooves in a main surface of the silicon. These V-shaped grooves correspond to natural crystal planes in the original silicon wafer, and are readily made, because the channels are naturally self-limiting in the etching process. When the channel plate with the V-shaped groove is bonded to a heater chip, the resulting channels or nozzles are triangular in cross-section, with the surface of the heater chip forming the third side of the triangle in addition to the straight sides formed by the V-groove of the channel plate. While this architecture provides many advantages in manufacture, the use of triangular-cross-section ejectors limits the cross-sectional area of the ejectors and can lead to practical problems such as unpredictable directionality of ejected droplets. It is therefore desirable to provide channels which are generally closer to a round shape in cross-section.

DESCRIPTION OF THE PRIOR ART

Alavi et al., "Laser Machining of Silicon for Fabrication of New Microstructures," discloses techniques for creating cavities within <110> or <100> surfaces of crystalline silicon. The cavities made according to this process form a relatively small opening in the main surface of the silicon, and the cavities gradually increase in size slightly beneath the main surface, and then decrease to form a sharp corner.

SUMMARY OF THE INVENTION

According to the present invention, there is provided an ink-jet printing apparatus, comprising a chip defining a main surface and a channel plate abutting the main surface of the chip. A channel is defined in the channel plate, the channel extending along an axis and defining a cross-section perpendicular to the axis. The cross-section includes four straight sides in the channel plate.

BRIEF DESCRIPTION OF THE DRAWINGS

In the drawings:

FIG. 1 is a perspective view showing a portion of an ink-jet printhead having channels according to the present invention; and FIGS. 2A and 2B are sectional views through a section of a channel shown in FIG. 1, showing two steps in a process for making the printhead of the present invention.

DETAILED DESCRIPTION OF THE INVENTION

FIG. 1 is a perspective view showing two ejectors of a printhead according to the present invention. A heater chip 10 includes two selectably-actuable heating elements 12 on the main surface thereof. As is known in the art, these heating elements 12 are capable of creating heat which nucleates liquid ink in response to a voltage applied thereon in response to digital image data. Abutting the main surface of heater chip 10 is a channel plate, shown in phantom as 14. Channel plate 14 has defined therein, in the surface thereof in contact with the main surface of heater chip 10, channels generally indicated as 16. As shown in the Figure, when the channel plate 14 is abutted against the main surface of heater chip 10, the open channels 16 in channel plate 14 are covered (except for their ends) and the heating elements 12 on the main surface of heater chip 10 are disposed within the channels 16.

As can be seen in the Figure, each channel 16 defines a length, or axis, from one end to the other, and a cross-section perpendicular to the length. According to the present invention, the cross-section of at least a portion of the channel 16 forms four straight sides within channel plate 14, and the main surface of heater chip 10 forms a fifth side. In the preferred embodiment, each of the straight sides are diagonal with respect to the main surface of channel plate 14, and of course also diagonal with respect to the main surface of heater chip 10. For reasons which will be described in detail below, the overall shape of the cross-section of a channel 16 is that of a truncated diamond or parallelogram, the truncation emerging from the intersection of the parallelogram with the main surface of the channel plate 14.

What is illustrated in the Figure is an essential portion of an ink-jet printhead, including the channel for retaining a quantity of liquid ink, and a heating element 12, which, at a particular time, nucleates the liquid ink in the channel, causing a quantity of the liquid ink to be pushed out one end of the channel 16 and onto a print sheet. As is well known in the art, a channel such as 16 is connected to an ink supply manifold (not shown) at one end, with the opposite end being effectively open for passage of liquid ink therethrough to the print sheet.

In the particular embodiment shown in the Figure, the channel 16 is of uniform cross-section throughout its effective length, although within the scope of the claimed invention, only a portion of the effective length of a channel such as 16 may be of the claimed shape. Similarly, although a heating element 12 is shown directly within the channel 16 as shown in the Figure, it is possible, according to a particular design of a printhead, to have the heating element placed elsewhere than in the channel having the claimed shape; the claimed cross-sectional shape may be apparent in a printhead, for example, only in a relatively short portion of the channel such as only at the nozzle end of the channel. However, from the practical standpoints of simplicity of manufacture and allowing a maximal amount of space over the heating element 12 for bubble nucleation without causing the bubble to emerge out the nozzle, the illustrated uniform cross-section is preferred. Incidentally, the channel of the claimed cross-sectional shape can be used in conjunction with other types of ink-jet printheads, such as a piezoelectric-based printhead.

It will be understood that what is shown in the Figure represents only the essential elements of an ink-jet printhead relevant to the claimed invention, and that there would further be, in a practical application of the invention, any number of additional structures, such as an intermediate layer of polyimide or other material, interposed between heater chip 10 and channel plate 14, as well as, for example, a recess or pit structure around the perimeter of the heating element 12.

FIGS. 2A and 2B illustrate two basic steps in the creation of the channels of the claimed shape in crystalline silicon. In FIG. 2A is shown a portion of a silicon member in which the channels 16 of channel plate 14 are created. There is placed on a main surface of what will be channel plate 14, a mask, corresponding to the locations of the channels to be made in the channel plate 14, in a manner generally familiar in the art. Such masks typically include, at least, an oxide layer indicated as 20 and a nitride layer. An opening 24 is made in the mask layer 20 in the general location where the channel is to be created. The opening 24 in the mask 20, exposes bare crystalline silicon which can be accessed by one of a variety of etchants.

In the first main step, a plasma etch of a certain depth is made into the structure of the channel plate 14. For this step an anisotropic reactive ion etch process is preferred, although sputtering or laser machining can also be used. Reactive ion etching is preferred because it is easily reproducible. The overall process results in a cavity, the outlines of which generally follow the shape of the opening 24 in the mask 20. The channels can then be covered with a nitride mask (not shown) after the plasma etch, so that the channels will not be etched further when an ink reservoir portion of the printhead (not shown) is created by etching.

FIG. 2B shows a subsequent essential step in the process, following the step of FIG. 2A, in which the initial cavity made in FIG. 2A is further processed with, preferably, a wet etch process, such as with KOH and water and isopropanol in a manner generally familiar in the art. As can be seen, this wet etch process causes the crystalline silicon to be etched along a set of <111> planes therein. The natural direction of these planes create the desirable diamond or parallelogram shape; as with forming a V-shaped trench in crystalline silicon, this process is self-limiting because of the crystal structure.

If the top surface, as shown in FIGS. 2A and 2B, of the silicon wafer is the <100> surface of the wafer, the wet etching process will be self-terminating, making this technique particularly convenient for mass production.

To create channel 16 of a cross-sectional size suitable for, for example, a 600 spi printhead, the overall depth of the channel 16 from the main surface of channel plate 14 to the bottom of the channel is approximately 17–18 micrometers. The ultimate depth of the final truncated-parallelogram channel relative to the wafer surface is dependent on the depth of the reactive ion etch and the width of the opening in the mask 20. A 600 spi printhead generally requires channels 30 micrometers wide at the widest point, leaving about 12 micrometers between adjacent channels. By a rough estimate, a 27-micrometers wide opening in the mask 20 and a 3-micrometer deep reactive ion etch will result, after the wet etch, in the desired width of the channel at its widest point.

An incidental practical advantage of the present invention is that the truncated-parallelogram shape affords relatively large surface areas for bonding, such as with an adhesive, the main surface of heater chip 10 to co-planar surfaces on channel plate 14, particularly as compared to a channel plate having V-shaped channels therein.

While the invention has been described with reference to the structure disclosed, it is not confined to the details set forth, but is intended to cover such modifications or changes as may come within the scope of the following claims.

We Claim:

1. An ink-jet printing apparatus, comprising:

a chip defining a main surface;

a channel plate bonded to the main surface of the chip; and a channel defined at an interface of the main surface of the chip and the channel plate, the channel extending along an axis and defining a cross-section perpendicular to the axis, the cross-section including four straight sides in the channel plate.

2. The apparatus of claim 1, at least two of the straight sides being diagonal with respect to the main surface of the chip.

3. The apparatus of claim 1, the cross-section forming a truncated parallelogram.

4. The apparatus of claim 1, each straight side of the channel being formed by a crystal plane of the channel plate.

5. The apparatus of claim 1, the channel plate comprising crystalline silicon, and each straight side of the channel being a <111> plane of the silicon.

6. The apparatus of claim 1, the chip including a selectably actuable heating element on the main surface.

7. The apparatus of claim 6, the heating element being disposed within the channel.

* * * * *